US006253654B1

(12) United States Patent
Mercurio

(10) Patent No.: US 6,253,654 B1
(45) Date of Patent: Jul. 3, 2001

(54) ELECTRIC STRINGED INSTRUMENT WITH INTERCHANGEABLE PICKUP ASSEMBLIES WHICH CONNECT TO ELECTRONIC COMPONENTS FIXED WITHIN THE GUITAR BODY

(76) Inventor: Peter G Mercurio, 21 1/2 Church St., Gloucester, MA (US) 01930

( * ) Notice: Subject to any disclaimer, the term of this patent is extended or adjusted under 35 U.S.C. 154(b) by 0 days.

(21) Appl. No.: 09/523,799

(22) Filed: Mar. 13, 2000

(51) Int. Cl.[7] ..... G10D 1/08

(52) U.S. Cl. ..... 084/267; 84/290; 84/291; 84/293

(58) Field of Search ..... 84/718, 723–726, 84/730–731, 743, DIG. 24, 267, 290, 291, 293, 294

(56) References Cited

U.S. PATENT DOCUMENTS

| | | | | |
|---|---|---|---|---|
| 4,425,831 | | 1/1984 | Lipman | 84/1.16 |
| 4,433,603 | | 2/1984 | Siminoff | 84/1.16 |
| 4,854,210 | | 8/1989 | Palazzolo | 84/1.15 |
| 4,872,386 | | 10/1989 | Betticare | 84/726 |
| 5,029,511 | | 7/1991 | Rosendahl | 84/743 |
| 5,252,777 | | 10/1993 | Allen | 84/726 |
| 5,637,823 | * | 6/1997 | Dodge | 84/743 |
| 5,637,832 | | 6/1997 | Dodge | 84/743 |
| 5,744,744 | * | 4/1998 | Wakuda | 84/650 |
| 5,786,539 | * | 4/1999 | Steinberger | 84/293 |
| 5,837,912 | * | 11/1998 | Eagen | 84/267 |
| 5,898,121 | * | 4/1999 | Riboloff | 84/728 |
| 5,929,362 | * | 7/1999 | Oteyza | 84/723 |
| 5,994,633 | * | 11/1999 | Norton | 84/290 |
| 6,008,440 | * | 12/1999 | Yamada | 84/291 |

* cited by examiner

*Primary Examiner*—Robert E. Nappi
*Assistant Examiner*—Kim Lockett

(57) ABSTRACT

An electric stringed instrument, e.g. an electric guitar, featuring a body having a rectangular shaped, through-the-body cutout between the neck and bridge, and having a connector in a portion of the cutout. Pins on the connector are wired to electronic control components that are permanently fixed in the body. A rapidly interchangeable pickup assembly containing one or more pickups, in any combination of single and dual coils, fits into the cutout. Many and varied pickup assemblies, each with different characteristics of tone, strength, and frequency range emphasis can be interchangeably installed into the cutout. A connector on the pickup assembly mates with the body connector, thus accomplishing an electrical connection between the pickups in the assembly and the control electronics. The pickup assembly, having no control electronics on it, is light, compact, and easily maneuvered with one hand into and out of the cutout from the rear of the instrument. Once securely installed, the pickup assembly is in the optimum position to respond to string vibration. This vibration is converted into an electrical signal, sent and processed through the control electronics to an external unit for amplification.

6 Claims, 8 Drawing Sheets

ELECTRIC STRINGED INSTRUMENT WITH INTERCHANGEABLE PICKUP ASSEMBLIES WHICH CONNECT TO ELECTRONIC COMPONENTS FIXED WITHIN THE GUITAR BODY

1. Field of Invention

This present invention relates in general to electric stringed instruments, e.g., electric guitars, and in particular to an electrical stringed instrument having interchangeable pickup assemblies having multiple pickups, which connect to electronic control components fixed within the body of the instrument.

2. Description of Prior Art

A traditionally built stringed instrument, e.g., an electric guitar, comes with one or more permanently installed pickups, mounted beneath the strings, and situated between the end of the neck's finger board and the bridge. The sound of the vibrating metal string is received into the pickup by way of a magnetic field created by the pickup's two main components: a bar magnet wound around with more than six thousand windings of a very thin gauge of copper wire. A disturbance in the magnetic field, produced by the vibrating string, causes the coil of wire wound around the magnet to become filled with a flow of current creating an electrical signal that is transmitted to a loudspeaker system for amplification. These pickups are directly wired to electronic control components permanently mounted in the "control cavity" of the guitar's body. Depending on the body shape and design, the electronic control components are mounted either directly through the face's wood, or onto a plastic or metal plate called a "pickguard," which is attached to the body's face with screws. Typically, control components consist of a volume control, a tone control, a switch to enable the user to select the pickup(s) to be active, and one or more small toggle switches that affect the tone quality of an individual pickup by varying the amount and direction of electrical flow through it. A pickup can only produce the tonal qualities that the manufacturer's specifications allow. The user can, therefore, access only the sound options limited to those installed pickups. When the user becomes dissatisfied with the sound options, he has to remove the pickups by unsoldering all of the wires of the old pickups and soldering in the connections for new pickups. The user is now, however, limited to the sound options of the new pickups. To overcome this limitation, the user is forced to a very expensive decision; i.e., to purchase several guitars, each with differently installed pickups giving the user different sound options.

Pickups are manufactured in one of three configurations: the "single-coil" pickup, consisting of one bar magnet with its wire windings, and having two leads for making electrical connections; a "tapped" single-coil pickup having three leads for making electrical connections, where, by use of a mini-toggle switch, half of the pickup is deactivated producing a thinner, more trebly tone; and the "dual-coil" pickup, consisting of two single coils joined together, either side by side or one atop the other, and having four leads for making electrical connections (four leads allow a greater number of wiring possibilities which allows for more tonal options). This third pickup form is also called a "Humbucking" pickup, or simply a "Humbucker." However, a dual-coil pickup is considered to be and functions as one pickup.

Regarding the neck to body construction of an electric guitar, one of three methods is used: the neck is permanently glued to the body; the neck is bolted on to the body, for easy removal in case of damage; or the neck and the center section of the body are fashioned out of one piece of wood, called "neck-through-body" construction.

The present invention represents a major improvement over the following relevant prior art: U.S. Pat. No. 4,425,831 to Lipman, U.S. Pat. No. 4,854,210 to Palazzolo, U.S. Pat. No. 5,252,777 to Allen, U.S. Pat. No. 5,029,511 to Rosendahl, U.S. Pat. No. 4,433,603 to Siminoff, U.S. Pat. No. 4,872,386 to Betticare, and U.S. Pat. No. 5,637,823 to Dodge. Firstly, the Lipman, Palazzolo, Allen, and Betticare patents accommodate only one pickup per module. This is very cumbersome for the user who would have three separate pickup modules to install or withdraw at one time. This present invention's pickup assembly, on the other hand, accommodates up to three pickups, in any combination of single-coils and/or dual-coil humbuckers. Thus, with one motion, and in seconds, the user can install a complete set of all of the commonly used pickup configurations. This ease of operation is especially appreciated at a live performance. Secondly, the Palazzolo, Betticare, Rosendahl, Lipman and Allen patents necessitate altering a third party's manufactured pickup design to achieve their goals. This is both costly and time consuming. This present invention does not modify the pickups as purchased in any way, and are installed in the assembly in the same manner to those permanently installed in any common electric guitar body. This is both advantageous to the builder and to the user: to the builder, in that no costly time is spent either in designing and making original pickups, or in altering market produced pickups; and to the user, in that the user can at any time purchase one or more of the hundreds of market produced pickups and install them him or herself in the assembly. Thirdly, The Rosendahl patent requires that the guitar's strings be slackened before a pickup module can be inserted or removed. Though not specifically stated in the text of the Allen, Palazzolo, and Betticare patents, it is none-the-less clear to users skilled in the art of guitar playing and building, that since the module must be carefully slid between the body face and the underside of the strings, effective installation or removal of their pickup modules necessitates some string slackening. This is both time- consuming and awkward, especially in a live performance. In addition to the deficiencies stated above to the Siminoff patent, the method of module insertion, through the sides of the guitar body into chambers containing electrical contacts is very awkward, as many of the entry locations are a difficult reach for the user. Fourthly, given the above mentioned pickup module inadequacies, except for the Dodge patent, the above patents do not allow for as comprehensive a wiring scheme as possible, which limits the tonal options available to the user. The Dodge patent, although representing an improvement over the above-mentioned patents, does posses several serious disadvantages, which this present invention addresses and improves greatly upon. Firstly, the cutout that goes completely through the body, into which the module is inserted, is extremely and unnecessarily large. This constrains Dodge to use the "neck-through-body" form of guitar construction. This present invention allows any of the three commonly used neck to body connections. Secondly, the module fitting into this cavity is also very large making insertion, removal, storage and transport more difficult. In addition to the pickups, the Dodge module contains all of the electronic control components; this makes for a very heavy and unwieldy module. Thirdly, because of its large size, in order for the module to be maneuvered into the cavity, the guitar must be removed from the user to gain adequate leverage. Fourthly, a guitar is connected to the amplifying device by a specialized cable with specialized plugs on the ends. In the Dodge patent, before one can make a module change, this cable must be disconnected from the guitar, and then reconnected after the module change. In this present invention, the cable does not need to be removed. In summary, each of the above-patented inventions has enough shortcomings that would deter one skilled in the art of guitar playing from using the invention.

Accordingly, there is a long felt need for a guitar which has easily interchangeable and transportable pickup assemblies and which allows manipulation of sound within each assembly.

SUMMARY OF INCLUDING OBJECTS AND ADVANTAGES

Summary

In accordance with the present invention there is provided a guitar having a cutout and a connector in a portion of the cutout. Pins on the connector are connected to guitar control electronics. An interchangeable pickup assembly fits into the cutout and has a connector thereon which mates with the connector on the body. The pickups are electrically connected to the connector on the pickup assembly to thereby make electrical connections between the pickups and the control electronics through the mating connectors on the body and pickup assembly. The control electronics include humbucker switches and at least two five-position switches. The humbucker switches allow an operator to selectively connect the two coils of a four-conductor humbucker pickup in series or parallel or in a split-coil wiring scheme. A first five-position switch allows selective turning "on" or "off" of the single or dual-coil pickups in any assembly having pickups in the bridge, middle, and neck positions, e.g. in a Stratocaster style guitar. A second five-position switch allows selective control of the single or dual-coil pickups in any assembly having pickups in the bridge and neck positions, e.g. in a Les Paul or Telecaster style guitar. Thus, with a guitar according to the present invention a player has unsurpassed flexibility of sound compared to the prior art. The operator can interchangeably use several pickup assemblies, which are small and easily transported. In addition, an operator can manipulate the connections made within each assembly through the control electronics.

Objects and Advantages

Accordingly, it is the object of this present invention to eliminate the disadvantages of the above-mentioned prior art and to provide a stringed instrument having interchangeable pickup assemblies having multiple pickups, which connect to electronic control components fixed within the body of the instrument.

Another object of the present invention is to provide an electric stringed instrument having interchangeable pickup assemblies which can be easily controlled by a single set of electronic control components fixed within the body of the instrument for generating a desired sound.

Yet another object of the present invention is to provide an electric stringed instrument having interchangeable pickup assemblies, which connect to electronic control components fixed within the body of the instrument, which is of a simple and cost efficient design.

Still another object of the present invention is to provide a stringed instrument having interchangeable pickup assemblies having multiple pickups, which connect to electronic control components fixed within the body of the instrument wherein the pickup assemblies are easily assembled and secured to the guitar and are as small and compact-as-possible for easy manipulation, storage, and transport.

Still another object of the present invention is to provide a stringed instrument having interchangeable pickup assemblies having multiple pickups wherein a commercially manufactured pickup's design need not be altered, thus making available to the user hundreds of commercially produced industry standard pickups.

Yet another object of this invention is to provide a stringed instrument having interchangeable pickup assemblies having multiple pickups wherein the strings need not be slackened while either installing or removing a pickup assembly.

Yet another object of this invention is to provide a stringed instrument having interchangeable pickup assemblies having multiple pickups that does not necessitate removing the cable connecting the guitar to the amplifier while either installing or removing a pickup assembly.

Yet another object of this invention is to provide a stringed instrument having interchangeable pickup assemblies having multiple pickups that does not necessitate unstrapping and removing the instrument from the user's body while either installing or removing a pickup assembly. These and other objects of the present invention will become apparent from a review of the description provided below.

Still further objects and advantages will become apparent from a consideration of the ensuing description and accompanying drawings.

PREFERRED EMBODIMENTS

Description

Figure 1:
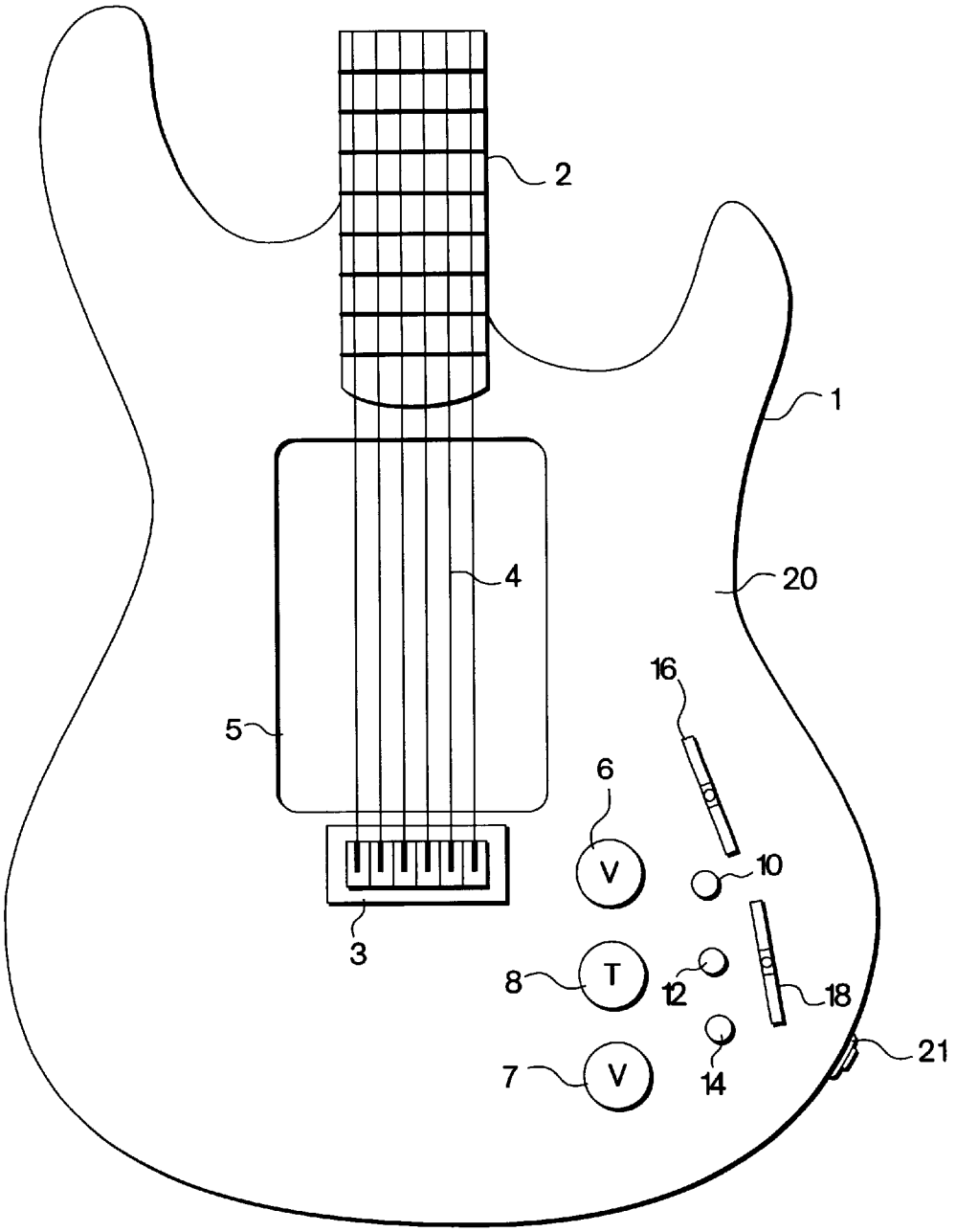
FIG. 1 is a front view of a guitar according to the invention showing an opening in the guitar body for receiving interchangeable pickup assemblies according to the invention.

Referring to FIG. 1 of the drawing, there is shown a preferred guitar body 1 according to the present invention.

The body 1 has a neck with finger board 2, a bridge 3 and strings 4 attached thereto in the conventional manner. A cutout 5 is formed completely through the body between the finger board and the bridge for receiving an interchangeable pickup assembly, as will be described in detail below. Operator controls including first 6 and second 7 volume controls and a tone control 8 are provided on the front face 20 of the body 1. Also, bridge position 14, middle position 12, and neck position 10 humbucker control switches are provided on the front face of the body along with first 18 and second 16 pickup selector switches. On the side edge of the body is output jack 21.

Figure 2:
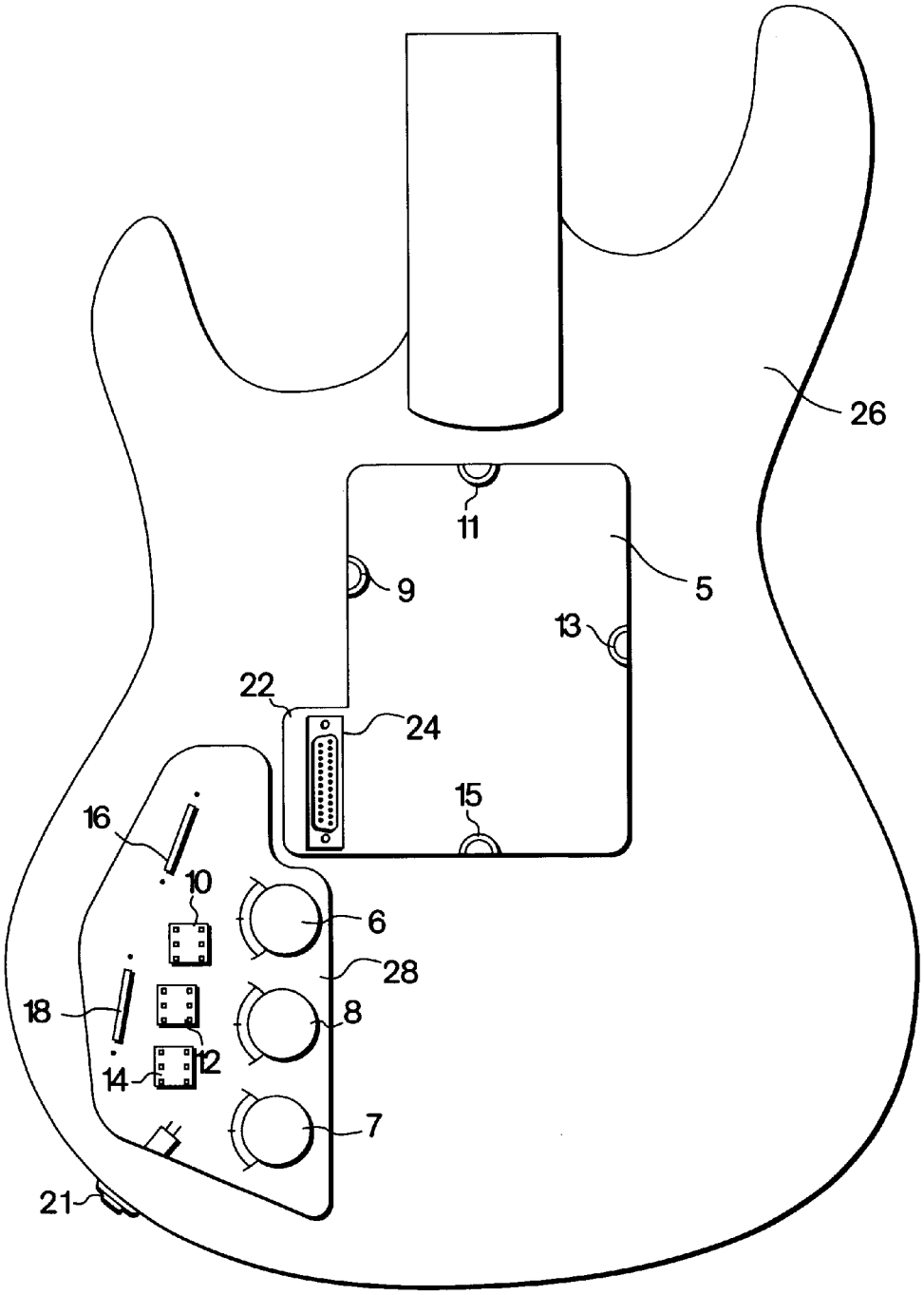
FIG. 2 is a rear view of the guitar of FIG. showing a connector mounted to the rear of the body for engaging a mating connector on a pickup assembly and also a cavity formed in the back of the guitar for receiving and housing the permanent electronic components.

As shown in FIG. 2, cutout 5 has a connector portion 22, which extends only a portion of the way through the thickness of the body from the rear face 26. Another cutout, a control cavity 28 is provided for receiving the electronic control components, e.g. the volume and tone controls, the humbucker switches, the pickup selector switches, etc. Once the electronic control components are installed, the electronics control cavity may be closed with a plate or cover (not shown).

A connector 24 is mounted within the connector portion 22 of the cutout 5. Specific pins on the connector 24 are electrically connected to the electronic control components, as will be described in detail below. The connector 24 mates with a corresponding connector on a pickup assembly to establish electrical connections between the pickups on the pickup assembly and the electronic control components. Preferably, the connector 24 is a common male or female DB-25 sub-connector. Bullet catches 9, 11, 13, 15 maintain the pickup assembly in the proper position in cutout 5.

Figure 3A:
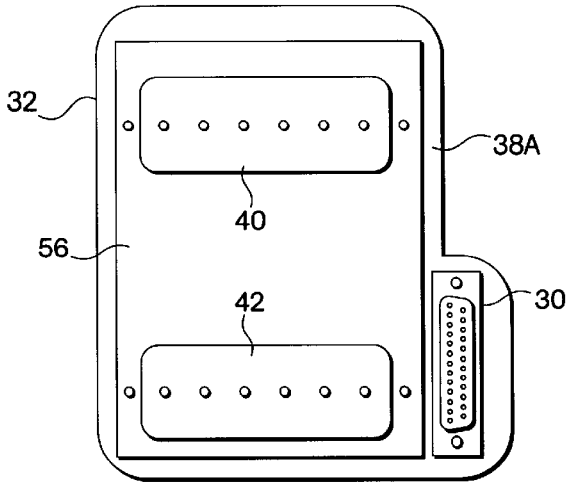
FIGS. 3A–3C show top views of three different pickup assemblies, wherein each of the assemblies has a different arrangement of pickups mounted thereto.
Figure 3B:
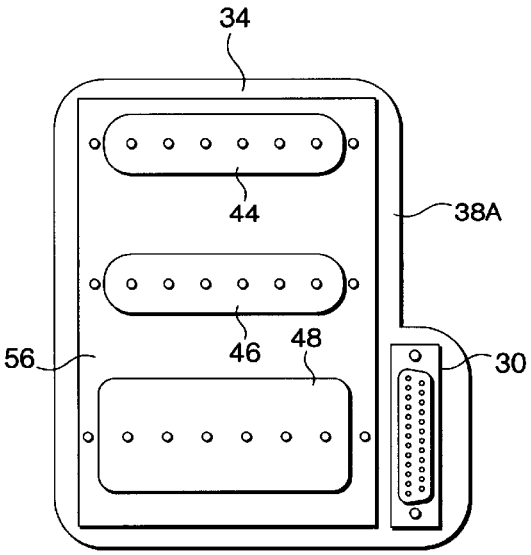
Figure 3C:
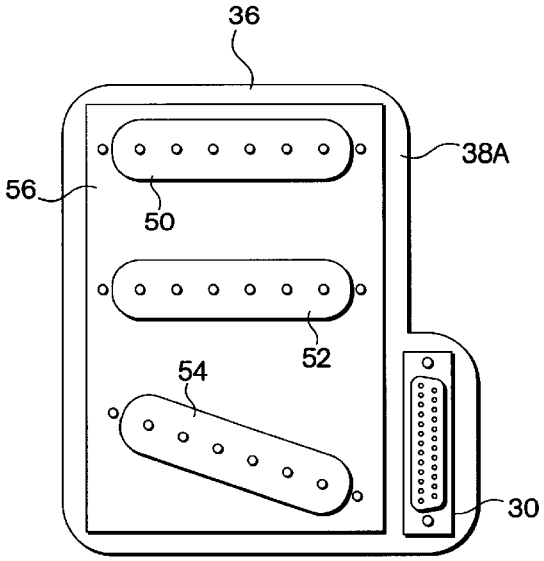

FIGS. 3A–3C show three exemplary pickup assemblies 32, 34, 36 according to the invention. Each pickup assembly includes an identical base 38B(base 38B is best seen in the isometric views in FIGS. 4A–4E) which is mounted onto baseplate 38A having a connector 30 mounted thereon for mating with the connector 24 in the connector portion 22 of the cutout 5 in the body 1. Pickups for each assembly, i.e. 40 and 42; 44, 46 and 48; and 50, 52, and 54 respectively, are mounted onto faceplate 56. The conductors from the pickups are wired to the connector 30 so that when the connector 30 is mated with the connector 24 on the body, electrical connection is made between the pickups and the electronic control components. Advantageously, the number and combination of pickups which may be installed on the pickup assembly is limited only by the space on the faceplate 56. Each assembly incorporates an identical base 38B and baseplate 38A, thus facilitating reliable connection of the assembly to the connector 24 for establishing connection of the pickups to the electronics.

Figure 4A:
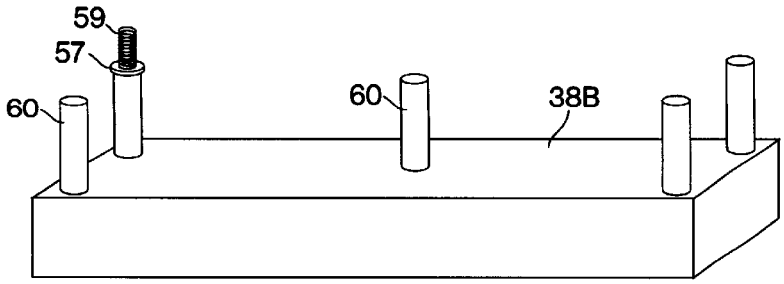
FIGS. 4A–AE show successive isometric views showing the steps involved in assembling a pickup assembly according to the invention.
Figure 4B:
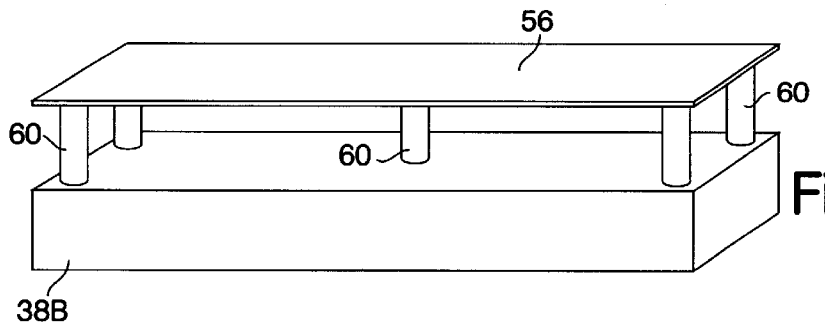
Figure 4C:
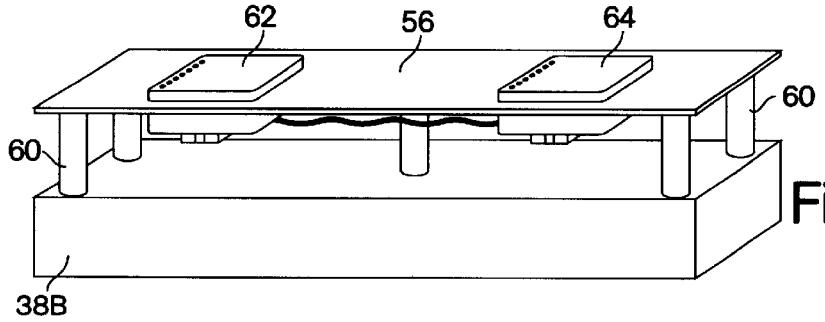
Figure 4D:
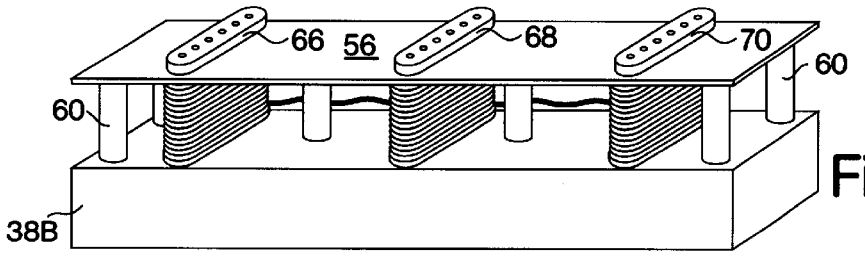
Figure 4E:
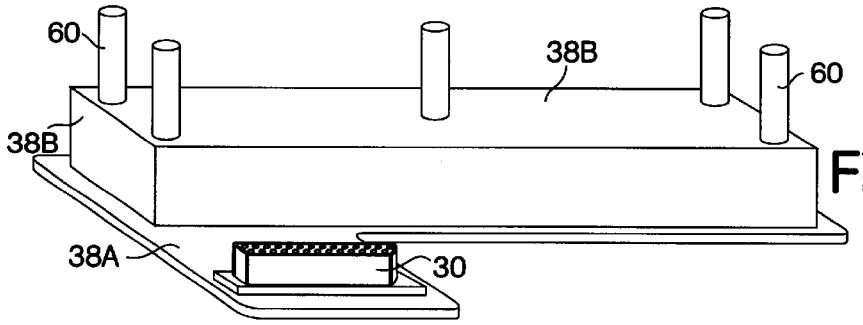
Figure 6:
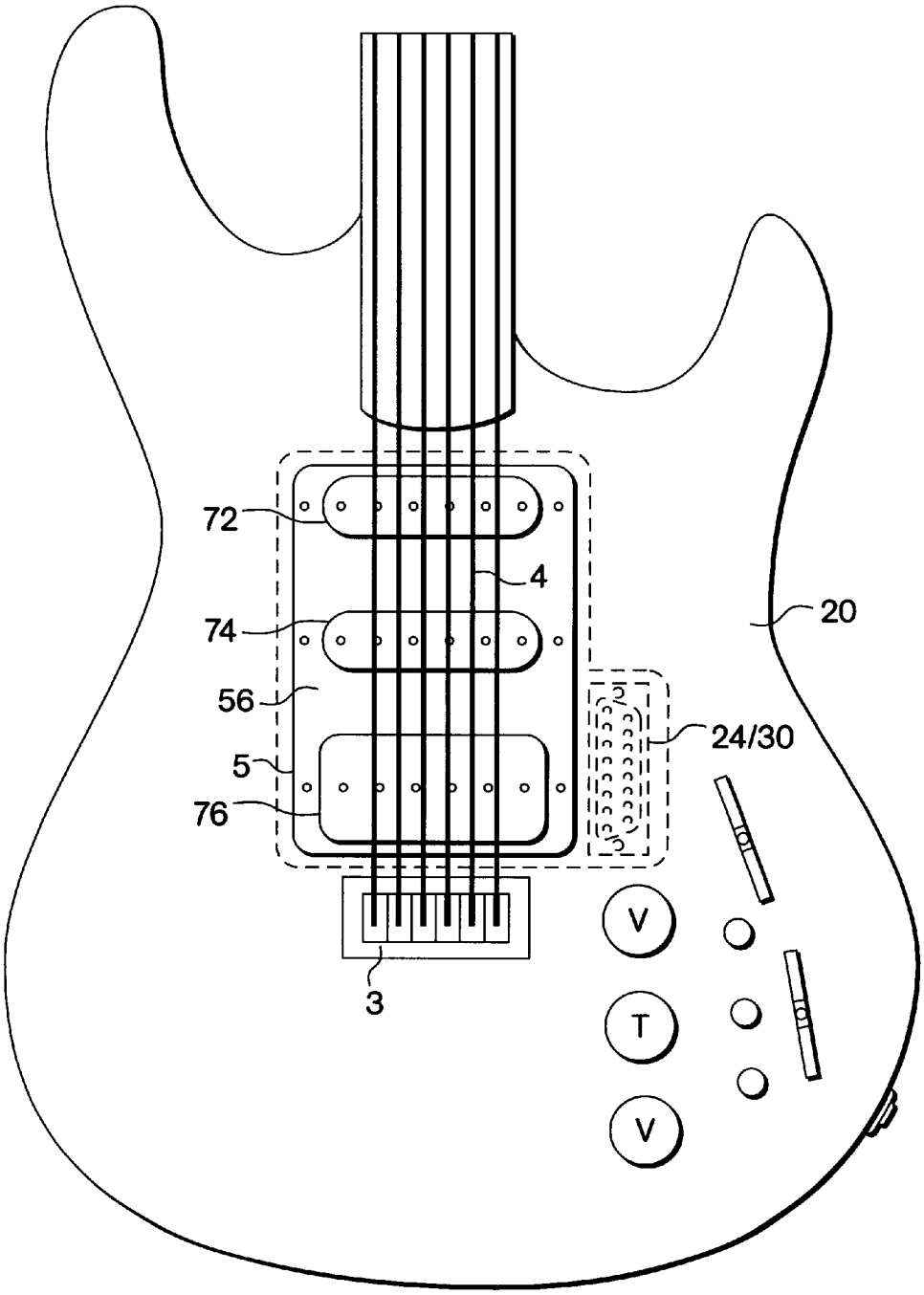
FIG. 6 is a front view of the guitar shown in FIG. 1 having the pickup assembly of FIG. 3C installed therein.

As shown in FIG.4A, the pickup assembly is assembled by installing the appropriate spacers 60 onto base 38B. Each spacer is lifted with a washer 57 and a spring 59 (shown only on one spacer in FIGS. 4A–4E) to adjust the thickness dimension of the assembly so that it will position the pickups appropriately underneath strings 4 when the assembly is installed into cutout 5 of the body with connectors 24 and 30 in mating engagement (as shown in FIG. 6). A blank faceplate 56 is installed on top of spacers 60 as shown in FIG. 4B. FIG. 4C shows a pickup assembly base 38B with spacers 60, and two Humbucking pickups 62 and 64 installed in cutouts in face plate 56, whose lead wires will eventually be connected to connector 30(not shown) on base plate 38A. FIG. 4D shows a pickup assembly base 38B with spacers 60, and three single-coil pickups 66, 68, 70 installed in cutouts in face plate 56, whose lead wires will eventually be connected to connector 30(not shown) on base plate 38A. FIG. 4E shows assembly base 38B and connector 30 mounted onto base plate 38A. Again, any number or arrangement of pickups may be installed on faceplate 56, limited only by available space.

Figure 5:
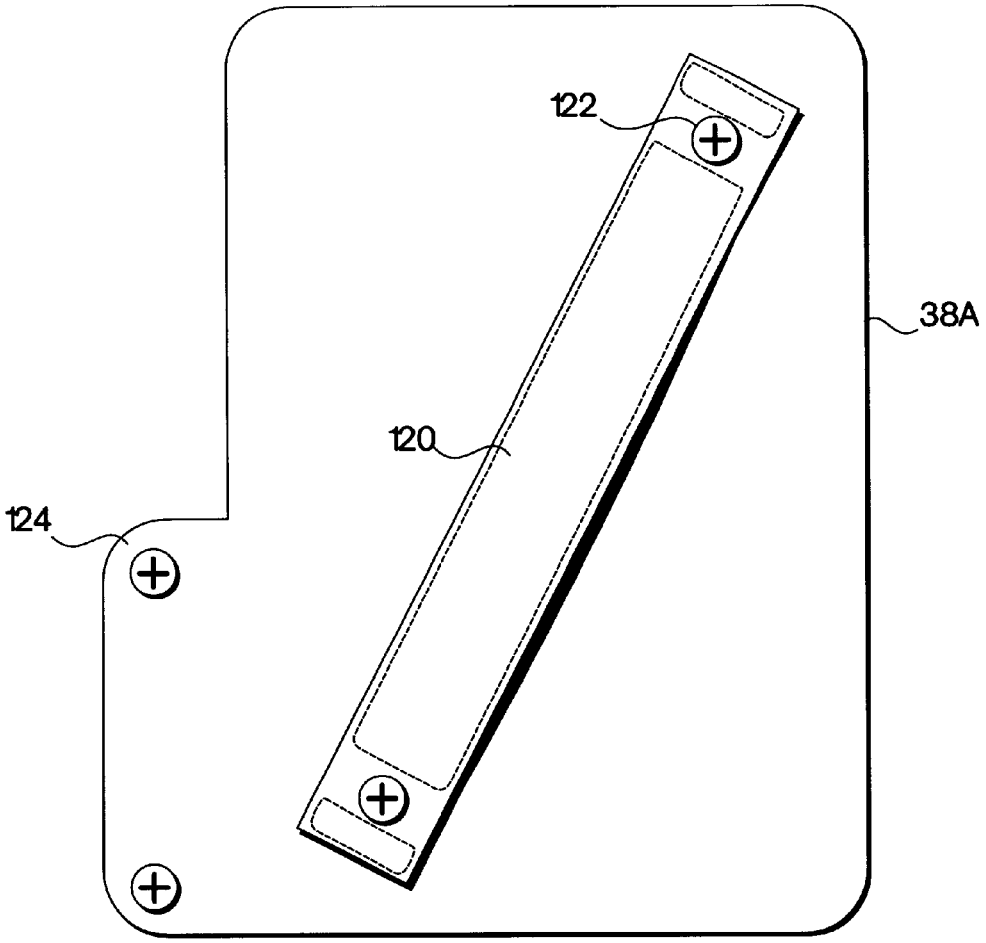
FIG. 5 shows a pickup assembly baseplate's strap used to facilitate insertion and removal of pickup assembly into and out of body cavity.

As shown in FIG. 5, on the backside of baseplate 38A is attached a strap 120 which facilitates manipulation of a pickup assembly into and out of body cutout 5. Also shown are strap mounting screws 122 and baseplate connector mounting screws 124.

With reference to FIG. 6, when a pickup assembly is installed into cutout 5, the connectors 24 and 30 are in mating engagement, and the pickups 72, 74, 76 are appropriately positioned underneath strings 4. Advantageously, the pickup assembly may be easily installed into the cutout by simply engaging the connectors 24 and 30. The position of the pickup assembly is firmly maintained in the cutout by spring loaded bullet catches 9, 11, 13, and 15 mounted on the inside surfaces of cutout 5 of the guitar body at the positions shown in FIG. 2. In dashed lines are the mating connectors 24 and 30, and the outline of the outer edges of the base plate 38A. These items are not visible from a face view of the guitar's body when a pickup assembly is installed, Not numbered in FIG.6 are the electronic control components, as they were numbered in FIG. 1.

Figure 7A:
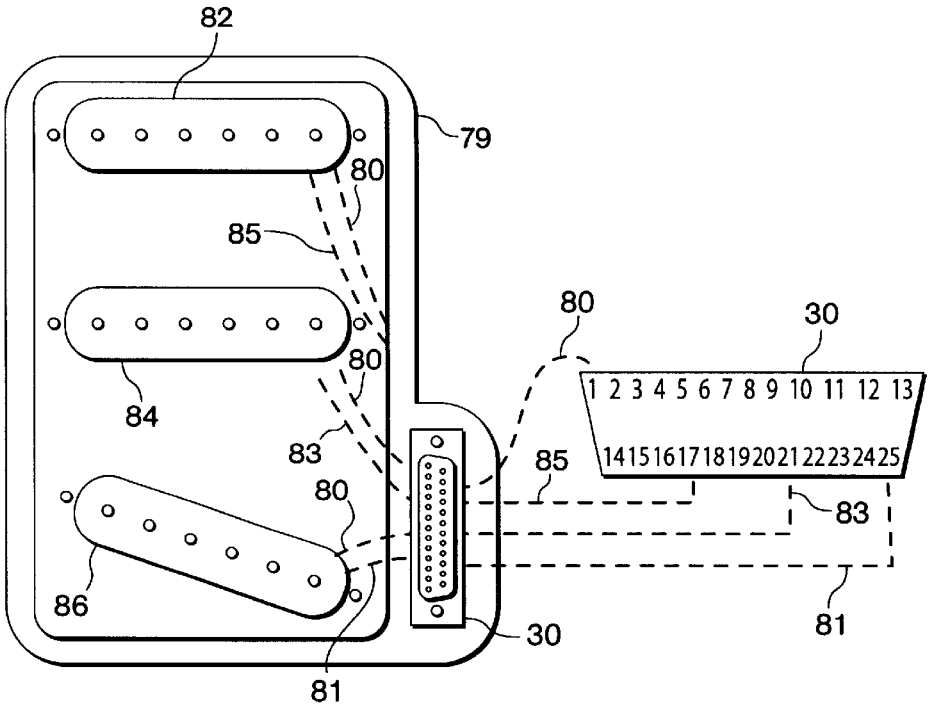
FIG. 7A shows an electrical connection diagram showing the wiring to a sub-connector in an embodiment of a pickup assembly according to the invention wherein each pickup is a two conductor, single-coil pickup.
Figure 7B:
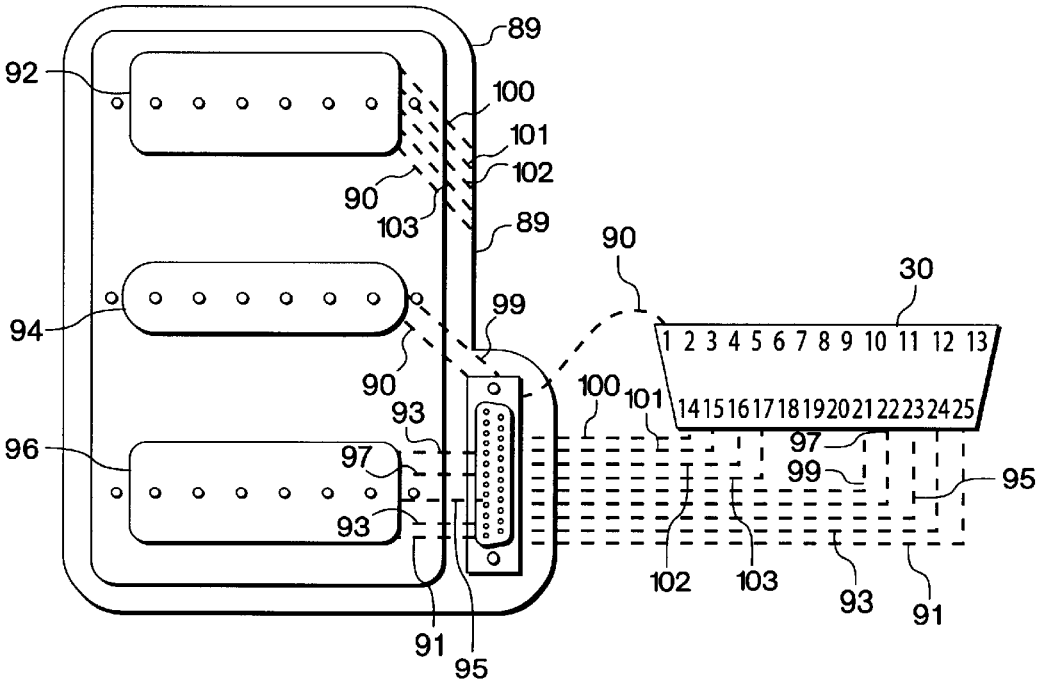
FIG. 7B shows an electrical connection diagram showing the wiring to a sub-connector of a 4-wire bridge position humbucking pickup, a two wire single-coil middle position pickup, and a 4-wire neck position humbucking pickup, respectively, in an embodiment of a pickup assembly according to the invention.

Turning now to FIGS. 7A–7B, there are shown in dashed lines preferred connections of pickup leads to the specific pins of connector 30 on a pickup assembly baseplate for various preferred pickup assemblies (leads wires are not visible when pickup assembly is fully assembled). FIG. 7A shows the connections for a pickup assembly 79 with three, two-conductor, single coil pickups 82, 84, 86. As shown in FIG. 7A, the hot lead 81 of the bridge position pickup 86 is connected to pin 25 of connector 30, while its common ground lead 80 is connected to pin 1. The hot lead 83 of the middle position pickup 84 is connected to pin 21 of connector 30 and its common ground lead 80 is connected to pin 1. The neck position pickup 82 has its hot lead 85 connected to pin 17 and its common ground lead 80 connected to pin 1 on connector 30.

FIG. 7B shows the wiring for a pickup assembly 89 having two, four-conductor humbucking pickups 92 and 96 (i.e. each pickup having two adjacent coils, but shown as one pickup), and a two-conductor single-coil pickup 94 in the middle position. The hot lead 95 from the first coil of the bridge position pickup 96 is connected to pin 23 on baseplate connector 30, and the hot lead 91 from the second coil is connected to pin 25. The ground lead 97 from the first coil is connected to pin 22 and the ground lead 93 from the second coil is connected to pin 24. The common ground leads 90 are connected to pin 1. The hot lead 101 from the first coil of the neck position pickup 92 is connected to pin 15, and the second coil hot lead 103 is connected to pin 17. The first coil ground lead 100 is connected to pin 14 and the second coil ground lead 102 is connected to pin 16. The common ground leads 90 are connected to pin 1. Hot lead 99 of middle position pickup 94 is connected to pin 21, while its common ground lead 90 is connected to pin 1.

Although the above-described pickup assembly embodiments and connections represent preferred embodiments, it will be readily understood by those skilled in the art that a wide variety of pickup assemblies can be made according to the invention. In fact, in the pickup assembly embodiments described above, the pickups in the bridge, middle, and neck positions for each assembly are consistently wired to the same pin designations on connector 30. For example, in any embodiment with a single-coil bridge position pickup, the hot lead of the coil is wired to pin 25 and the ground is wired to pin 1. The table below summarizes the preferred pickup connections to the connector 30 depending on the pickup position.

| Pickup and Position | Lead | Connector Pin |
|---|---|---|
| Two Conductor Bridge Position | Hot | 25 |
| | Gnd | 1 |
| Two Conductor Middle Position | Hot | 21 |
| | Gnd | 1 |
| Two Conductor Neck Position | Hot | 17 |
| | Gnd | 1 |
| Four Conductor Bridge Position | Gnd #1 | 22 |
| | Hot #1 | 23 |
| | Gnd #2 | 24 |
| | Hot #2 | 25 |
| | Common Gnd | 1 |
| Four Conductor Middle Position | Gnd #1 | 18 |
| | Hot #1 | 19 |
| | Gnd #2 | 20 |
| | Hot #2 | 21 |
| | Common Gnd | 1 |
| Four Conductor Neck Position | Gnd #1 | 14 |
| | Hot #1 | 15 |
| | Gnd #2 | 16 |
| | Hot #2 | 17 |
| | Common Gnd | 1 |
| Two Conductor Tele Style Bridge | Hot | 12 |
| | Gnd | 1 |
| Two Conductor Tele Style | Hot | 13 |
| | Gnd | 1 |

With the above pin designations, a user can build a pickup assembly having any arrangement of two and/or four conductor pickups for use in connection with the guitar and control electronics of the present invention. Obviously, however, the pin designations can vary with associated variations in the control electronics wiring.

The humbucker control switches 10, 12, 14 (shown in FIG. 1) are connected to pins on body connector 24. For example, pin 2 of the bridge position humbucker switch is connected to pin 22 of the connector 24(not shown), and pin 1 of the bridge position humbucker switch is connected to pin 25 of the connector 24 (not shown).

For a two-conductor pickup, the humbucker switches are bypassed and the hot lead of the pickup is connected to one of the two five-position switches 16, 18. For the four conductor pickups, however, the humbucker switches 10, 12, 14 provide a means for making various desirable connections between the two coils of the pickup in the position corresponding to the switch. When the bridge position 14, neck position 10, and/or middle position 12 humbucker switch is in the up position, the two coils of the respective pickup(s) are connected in parallel. When the bridge position 14, neck position 10, and/or middle position 12 humbucker switch is in the middle position (this is also called the "split" coil position) only one of the coils of the respective pickup(s) is active. When the bridge position 14, neck position 10, and/or middle position 12 humbucker switch is in the down position, the two coils of the respective pickup (s) are connected in series. With this arrangement, an operator has advantageous flexibility in manipulating the sound of the guitar.

The hot leads out from the bridge, middle, or neck position humbucker switches are routed to both five-position pickup selector switches 16 and 18. Five-position switch 18 allows selective connection of the pickups to volume control 7 according the switch position to turn the pickup "on" or "off." The connections made in each switch position of five-position switch 18 are shown the table below:

| Position | Connection Made |
|---|---|
| 1 | Only Bridge Position Pickup is On |
| 2 | Bridge and Middle Position Pickups are On |
| 3 | Only Middle Position Pickup is On |
| 4 | Middle and Neck Position Pickups are On |
| 5 | Only Neck Position is On |

Volume control 7 also has an internally mounted "push/pull" switch (not visible), which when in the pulled up position, makes the neck pickup active along with those of the selected five-position switch setting described above. Thus, the first five-position switch 18 allows selective control of the "on" or "off" state of the bridge, middle, and neck position pickups, allowing further sound versatility.

Five-position switch 16, in connection with the second volume control 6 and its internally mounted "push/pull" switch (not visible), controls single or dual coil pickups in any pickup assembly having only bridge and neck position pickups. When in the up position the push/pull switch reverses the phase relationship when both bridge and neck pickups are active. The five-position selector switch 16 allows selective connection of the pickups to volume control 6 according the switch position to turn the pickup "on" or "off." The connections made in each switch position of five-position switch 16 are shown in the table below:

| Position | Connection Made |
|---|---|
| 1 | Only Bridge Position Pickup is On |
| 2 | Bridge and Neck Position Pickups in Parallel |
| 3 | Only Neck Position Pickup is On |
| 4 | Neck Position Connected through treble cut capacitor |
| 5 | Bridge and Neck Position Pickups in Series |

All electrical current is sent through output jack 21 (shown in FIGS. 1, 2, 6) to an external amplifier via a standard guitar cable.

Figure 8:
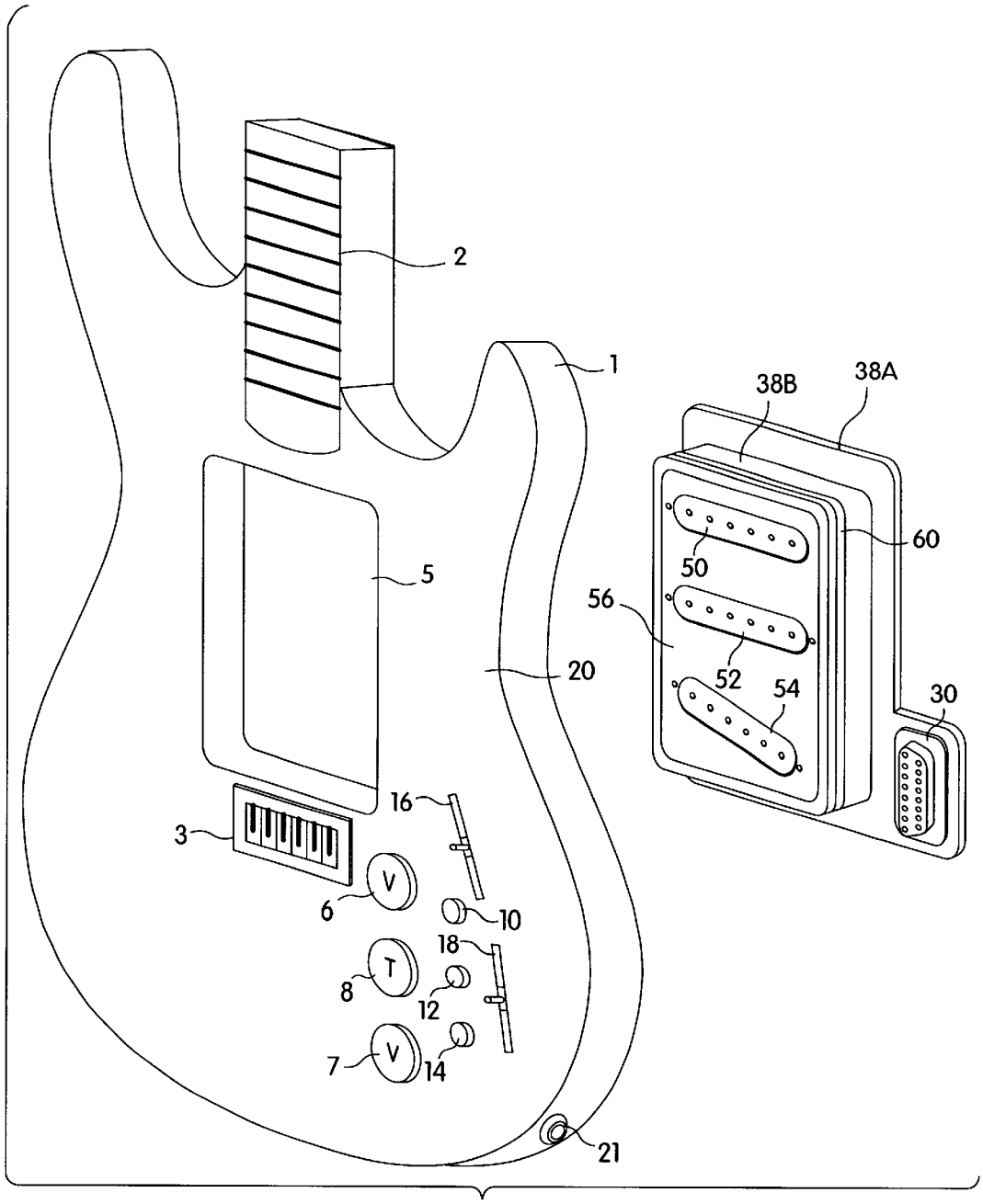
FIG. 8 is a 3-dimensional view of the invention showing an electric guitar with the body cutout, and a pickup assembly positioned for insertion into the body cutout.

FIG. 8 is a three-dimensional view of the present invention showing a fully assembled pickup assembly poised for insertion into body cutout 5 from the rear of the body. Part numbers are consistent with all previous figures. FIG. 8 is also intended for use in the PTO's Official Gazette.

Thus, according to the invention there is provided a guitar having a cutout and a connector in a portion of the cutout. Pins on the connector are connected to guitar control electronics. An interchangeable pickup assembly fits into the cutout and has a connector thereon which mates with the connector on the body. The pickups are electrical connected to the connector on the pickup assembly to thereby make electricals connections between the pickups and the control electronics through the mating connectors on the body and pickup assembly. The control electronics include at least one volume control, at least one tone control, at least one humbucker switch and preferably, two five-position pickup selector switches (although, all connections could be made to just one five-position switch with a minimal loss of tonal options). The humbucker switches allow an operator to selectively connect the two coils of a four-conductor humbucker pickup in series, parallel, or split configuration. A first five-position switch allows selective turning "on" or "off" of the single or dual-coil pickups in the bridge, middle, and neck positions. A second five-position switch allows selective control of any assembly having single or dual-coil pickups only in the bridge and neck positions.

Thus with a guitar according to the present invention a player has unsurpassed flexibility of sound compared to the prior art. The operator can interchangeably use several pickup assemblies, which are small and easily transported. In addition, an operator can manipulate the connections made within each assembly through the control electronics.

The embodiments, which have been described herein, are but some of the several which utilize this invention and are set forth here by way of illustration but not of limitation. It is obvious that many embodiments, which will be readily apparent to those skilled in the art, may be made without departing materially from the spirit and scope of this invention.

PREFERRED EMBODIMENT

Operation

The user of this present invention will maintain the guitar 1 (FIG. 1) to his own body in the customary manner, either with a guitar strap if standing, or without one if sitting. To install a pickup assembly into the body's cutout 5 (FIG.1), the user will grasp the guitar's neck/finger board 2 (FIG.1) with one hand and pull and pivot the instrument slightly away from his body to expose and provide access to cutout 5 and body connector 24 (FIG. 2). He will then slide the fingers of his other hand between baseplate 38A and strap 120 (FIG. 5) of any fully assembled pickup assembly (top views shown in FIGS. 3A, 3B, and 3C with baseplate connector 30; partial assemblies in isometric views shown in FIGS. 4A–4E) bringing the entire assembly toward cutout 5. After carefully positioning the assembly into cutout 5 so that the baseplate connector 30 properly lines up and mates with body connector 24 (FIG. 2), the assembly is given a firm push, engaging bullet catches 9, 11, 13, 15 (FIG.2) which hold the assembly securely in cutout 5, and positioning the pickups at the proper distance to strings 4. FIG. 6 shows a face view of guitar 1 with an installed pickup assembly 56. The position of the mated connectors 24/30 in dashed lines are shown in transparent view, but are normally not visible from the face of the guitar body. This is all achieved without slackening the strings, as is the case in prior art.

If the installed pickup assembly contains three pickups (for example FIGS. 3B, 3C) the user can select which pickup(s) he wishes active by using five-position pickup selector switch 18 (FIG. 1). The first position makes the bridge pickup alone active; the second position makes the bridge and middle pickups active; the third position makes the middle pickup alone active; the fourth position makes the middle and neck pickups active; and the fifth position makes the neck pickup alone active. If the user wishes the bridge and neck pickups to be active, he will first set the selector switch to the first position, and then pull upward on volume 7(FIG. 1), engaging a "push/pull" switch that is internally mounted to volume 7, which includes the neck pickup into the circuit. If the user wishes all three pickups to be active, he will first set selector switch 18 to the second position, and then pull upward on volume 7, which again includes the neck pickup into the circuit. If any of the pickups in this assembly is a two-coil, 4-wire humbucker (FIG. 7B ), the user can change the tone of the pickup by using mini-toggle switches 10, 12, or 14 (FIG. 1). In the downward position, the two coils are connected in series; in the middle position only one of the two coils is active; and in the upward position, the two coils are connected in parallel. Variable tone control 8 (FIG. 1) determines the overall amount of treble in conjunction with the above switch settings.

If the installed pickup assembly contains two pickups (FIG.3A), the user can select which pickup(s) he wishes active by using five-position pickup selector switch 16 (FIG. 1). The first position makes the bridge pickup alone active; the second position makes the bridge and neck pickups active in a parallel connection; the third position makes the neck pickup alone active; the fourth position makes the neck pickup alone active but passes the signal through a treble cutting capacitor(not shown), producing a bassier tone; and the fifth position makes the bridge and neck pickups active in a series connection. In the same manner, as explained in the preceding paragraph above, if any of the pickups in this assembly is a two-coil, 4-wire humbucker (FIG.7B), the user can change the tone of the pickup by using mini-toggle switches 10 and 14 (FIG.1). Again, variable tone control 8 (FIG. 1) determines the overall amount of treble. Volume control 6 (FIG. 1) controls the overall amount of volume output. Volume 6 also has a "push/pull" switch internally mounted to it. When in the pulled position, bridge and neck pickups sounding together are in an "out-of-phase" state, characterized by a treble, hollow tone.

If the installed pickup assembly has only one pickup (not shown), it can be wired to either five-position selector switch 16 or 18 (FIG.1), and the user will find it at the first position.

On the edge of the guitar body is a customary standard output jack 21 (FIGS. 1, 6), which connects the guitar electronics to an amplifying unit, or "amp," via a standard guitar cable.

When the user wishes to change a pickup assembly he simply grasps the pickup assembly strap and pulls straight out, disengaging the two mating electrical connectors. Now, a different pickup assembly can be installed, yielding completely new sound and tonal options. Again, slackening the strings is not necessary, unplugging the guitar cable from the guitar is not necessary (no annoying noise or hum is produced, as the electronics control cavity is fully grounded), and finally, unstrapping the guitar from the user's body is not necessary. Unlike all other guitars, there are no sound or tonal limitations to this present invention. Any standard, commercially available pickup can be used. Because the pickup assembly contains no electronic control components, the entire pickup assembly is small and compact enough to fit in the palm of the users hand, making it light, easy to store and transport, and most importantly, easy to install "on the fly." All pickup assemblies share the same electronic control components, which are permanently mounted inside control cavity 28 (FIG.2), the control knobs are accessed from the face 20 of the guitar body 1 (FIG. 1). This eliminates the necessity of duplicating control components on each and every pickup assembly, as is the case with prior art. This reduces manufacturing time and costs, and ultimately the price to the user. And very important to the user, this invention eliminates his need to purchase and bring multiple guitars to performances. Because of the many advantages contained in this instrument, this invention is far more user practical, friendly, and satisfying to use over all prior art.

CONCLUSIONS, RAMIFICATIONS, AND SCOPE

Conclusions

Accordingly, it can be seen that this present invention with its compact, lightweight, and easily and inexpensively constructed pickup assemblies affords the guitarist unprecedented freedom. Freedom, firstly, from limited tone and sound options, as any pickup on the market can be used in these pickup assemblies. Freedom, secondly, from having to purchase several costly instruments, each with a different feel to get used to. Freedom, thirdly, from having to bring several guitars to performances. Freedom, fourthly, from having to slacken strings, or unplugging the cable, or unstrapping the guitar from the user's body before changing pickup assemblies, Freedom, finally, from the cumbersome, unwieldly, and weighty designs of prior art. In addition, this present invention affords the guitarist the freedom to be inspired and to create with confidence, knowing that a different sound is just a pickup assembly away, and that an assembly change is easy, quick and effortless. Since the user can purchase different pickups on his own, by shopping around for the best price, he can control the final cost of a fully constructed pickup assembly. Also, this guitar with an installed pickup assembly is considerably lighter in weight that almost all other guitars on the market, which reduces significantly the shoulder fatigue, factor to the user.

Ramifications

Although the description above contains much specificity, this should not be construed as limiting the scope of the invention but as merely providing illustrations of some of the presently preferred embodiments of this invention. Various other embodiments and ramifications are possible within its scope. For example, the control electronics are very comprehensive, responsive, and easily accessed, but can be added to or deleted from to suit the particular needs of the user, especially as new and improved components become available. The guitar's body can be of any color or shape, it can be made of a traditionally carved wooden design, or it can be made of any hi-tech material which has been cast in a mold with a pre-designed shape. The only requisite is the formation of the body cavity to accommodate the pickup assembly. The pickup assembly chassis itself can be either made of wood, plastic, plastic and wood, or again from a hi-tech material that has been cast in a mold. Also, with the advancement in pickup and electronics technology, the materials and methods employed in the presently preferred embodiment of this invention will change. Finally, this invention with its interchangeable pickup assemblies encourages the guitarist to grow in his musical endeavor. If he plays Rock'n Roll, this instrument does it. If he moves into Country and Western, this instrument does it as well. If he expands to Blues or Jazz, this invention does it all.

Scope

Thus, the scope of the invention should be determined by the appended claims and their legal equivalents, rather than by the examples given.

What is claimed is:

1. An electric stringed musical instrument, for example, an electric guitar having:

a body with a rectangular and longitudinal cutout extending completely through the thickness, of said body under the strings of said instrument body, where said cutout is positioned between a neck and a bridge for receiving said pickup assembly, said cutout spanning from the end of said neck where said neck joins said body, to said bridge mounted on said body, and having an electrical connector, being fixed in a portion of said cutout; and having a set of pins directly wired to a set of electronic components for sound manipulation; and said components being permanently fixed in a control cavity in said body; and a pickup assembly comprised of a pickup assembly chassis dimensioned to fit in said cutout composed of a baseplate, a base. a faceplate onto which pickups are mounted, where said faceplate's distance from said base and said instrument strings are adjustably maintained with screws, springs and spacers, and, said chassis containing one or more, pickups, and a pickup assembly connector which mate with said connector in said cutout when said pickup assembly is inserted into said cutout in said body.

2. The electric stringed musical instrument of claim 1, wherein said body is composed of any material that can be conformed to a suitable shape, for example, but not limited to wood, plastic, or any hi-tech material which can be poured into a mold to achieve a shape.

3.The electric stringed musical instrument of claim 1, wherein said set of electronic control components is comprised of one or more volume controls, one or more tone controls, one or more pickup selector switches, one or more mini-toggle switches, and an output jack.

4. The electric stringed musical instrument of claim 1, wherein wires from said pickups are directly connected to pins in said connector in said pickup assembly, said connector being mounted onto said baseplate.

5. The electric stringed musical instrument of claim 1, wherein said connector in said pickup assembly mates with said connector in said cutout in said body accomplishing an electrical connection between said pickups and said set of electronic control components, said output jack transmitting an electrical signal to an external amplifier via a cable.

6. The electric stringed musical instrument of claim 1, wherein said pickup assembly's depth of insertion into said cutout is restricted by said baseplate, as said baseplate's dimensions are slightly larger than dimensions of said cutout and thus overlaps said cutout slightly onto said body.

* * * * *